US009068538B2

(12) United States Patent
Ozeki

(10) Patent No.: US 9,068,538 B2
(45) Date of Patent: Jun. 30, 2015

(54) INTAKE SYSTEM FOR INTERNAL COMBUSTION ENGINE

(71) Applicant: SUZUKI MOTOR CORPORATION, Hamamatsu-shi, Shizuoka (JP)

(72) Inventor: Hisashi Ozeki, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 13/857,197

(22) Filed: Apr. 5, 2013

(65) Prior Publication Data

US 2013/0263809 A1 Oct. 10, 2013

(30) Foreign Application Priority Data

Apr. 5, 2012 (JP) ..... 2012-086715

(51) Int. Cl.
*F02M 35/04* (2006.01)
*F01L 13/00* (2006.01)
*F02M 35/16* (2006.01)

(52) U.S. Cl.
CPC ..... *F02M 35/044* (2013.01); *F01L 13/0015* (2013.01); *F01L 2013/0052* (2013.01); *F01L 2013/0078* (2013.01); *F01L 2820/032* (2013.01); *F01L 2820/041* (2013.01); *F02M 35/162* (2013.01); *F01L 13/0042* (2013.01)

(58) Field of Classification Search
CPC ... F02M 35/044; F02M 35/04; F02M 35/048; F02M 35/16; F02M 35/161; F02M 35/162
USPC ..... 123/184.21, 198 E, 195 C
See application file for complete search history.

(56) References Cited

U.S. PATENT DOCUMENTS

| | | | | |
|---|---|---|---|---|
| 5,205,244 | A | 4/1993 | Nakamura et al. | |
| 6,863,044 | B2 * | 3/2005 | Nakamura et al. | 123/198 E |
| 8,096,272 | B2 * | 1/2012 | Takahashi et al. | 123/90.16 |
| 2004/0134454 | A1 | 7/2004 | Yamauchi | |

(Continued)

FOREIGN PATENT DOCUMENTS

| | | | |
|---|---|---|---|
| DE | 102008023450 | B4 * | 11/2008 |
| EP | 2620606 | | 7/2013 |
| JP | 2004-084566 | A | 3/2004 |

OTHER PUBLICATIONS

JP2004084566A, machine translation of Detailed Description, Yamauchi, Mar. 18, 2004, pp. 1-15.*

(Continued)

*Primary Examiner* — Lindsay Low
*Assistant Examiner* — Grant Moubry
(74) *Attorney, Agent, or Firm* — Troutman Sanders LLP

(57) ABSTRACT

An intake system for an internal combustion engine includes: a cylinder block in which a combustion chamber is formed; a cylinder head in which a plurality of intake ports to introduce the combustion air into the combustion chamber are formed; a cylinder head cover disposed on an upper side of the cylinder head; a cam position sensor that detects positions in an axial direction of a motor of a cam slide mechanism and an intake side cam, the motor being disposed on an upper side of the cylinder head cover and driving the intake side cam; and an air cleaner disposed on an upper side of the cylinder head cover, the motor, and the cam position sensor, and a concave portion deeper than the other portions is formed in a bottom wall portion of the air cleaner, and is disposed between the motor and the cam position sensor.

4 Claims, 12 Drawing Sheets

(56) References Cited

U.S. PATENT DOCUMENTS

| | | | | |
|---|---|---|---|---|
| 2004/0139935 | A1 | 7/2004 | Yamauchi | |
| 2007/0221182 | A1* | 9/2007 | Takahashi et al. | 123/635 |
| 2007/0227509 | A1* | 10/2007 | Ueda et al. | 123/509 |
| 2012/0304965 | A1* | 12/2012 | Uchiyama et al. | 123/399 |
| 2013/0192553 | A1 | 8/2013 | Ozeki | |

OTHER PUBLICATIONS

European Search Report, dated Nov. 6, 2013, which issued during the prosecution of European Patent Application No. 13162306.8, which corresponds to the present application.

* cited by examiner 1
11
12
3
14
Fr
Rr
Tp
Bt
111
112
113
114
115
121
122
123
124
125
126
131
132
141
142
143
144
151,15
152,15
201
202
203
204
205
206
210
211
212
213
214
323
5

Tp
R
L
Bt
37
371
377
372
34
374
33
353
354
375
32
357
321

INTAKE SYSTEM FOR INTERNAL COMBUSTION ENGINE

CROSS-REFERENCE TO RELATED APPLICATION

This application is based upon and claims the benefit of priority of the prior Japanese Patent Application No. 2012-086715, filed on Apr. 5, 2012, the entire contents of which are incorporated herein by reference.

BACKGROUND OF THE INVENTION

1. Field of the Invention

The present invention relates to an intake system for an internal combustion engine. Particularly, the present invention relates to an intake system for an internal combustion engine that takes in, cleans, and supplies the combustion air from outside to the internal combustion engine.

2. Description of the Related Art

A motorcycle has an intake system (intake system for an internal combustion engine) for supplying the combustion air to the engine (internal combustion engine). An air cleaner that cleans the air taken in from outside and supplies it to an engine combustion chamber is provided in the intake system for the engine (internal combustion engine) of the motorcycle. Additionally, some air cleaners provided in an intake system for a multi-cylinder engine have a function to distribute the air taken in from outside to each combustion chamber of the engine. For example, Patent Document 1 discloses a configuration in which a plurality of intake pipes are connected to an air cleaner. Additionally, according to the configuration of Patent Document 1, the combustion air can be distributed to each combustion chamber by the plurality of intake pipes.

Generally, a motorcycle has a valve apparatus that opens and closes between an intake port and a combustion chamber. A general valve apparatus has an intake valve driven by a cam, and opens and closes between the intake port and the combustion chamber by the intake valve. In some motorcycles, a solid cam is applied to the cam that drives the intake valve. The solid cam moves in an axial direction, and thereby can steplessly change a lift amount and lift timing of the intake valve. In this respect, in such a configuration, a drive source that moves the solid cam in the axial direction, and a cam position sensor that detects an axial position of the solid cam are disposed at a cylinder head cover, for example. In this case, it is necessary to avoid interference of an air cleaner disposed on an upper side of the cylinder head cover with a motor and a cam position sensor. As a configuration for avoiding the interference, for example, it is conceivable to dispose the air cleaner on a further upper side of the motor and the cam position sensor. However, such structure increases a size of an engine unit in a height direction. In addition, a configuration can be conceivable in which a cutout etc. are formed in the air cleaner so as not to interfere with the motor and the cam position sensor. However, such a cutout etc. formed in the air cleaner may cause a deviation in a flow of the air inside the air cleaner, and the air cannot be equally distributed to the combustion chamber. Furthermore, a capacity of the air cleaner may be reduced.

Patent Document 1

Japanese Laid-open Patent Publication No. 2004-84566

SUMMARY OF THE INVENTION

In view of the above-described actual circumstances, an object of the present invention is to prevent or suppress occurrence of variation in an amount of combustion air distributed to each combustion chamber of an internal combustion engine in an intake system for the internal combustion engine.

In order to attain the above-described object, the present invention is an intake system for an internal combustion engine that supplies the combustion air to the internal combustion engine having a combustion chamber and an intake valve that opens and closes the combustion chamber, and the intake system includes: a cylinder block in which the combustion chamber is formed; a cylinder head in which a plurality of intake ports to introduce the combustion air into the combustion chamber are formed; a cylinder head cover disposed on an upper side of the cylinder head; a motor that is disposed on an upper side of the cylinder head cover, and exerts drive force to a cam slide mechanism that axially moves a solid cam that drives the intake valve; a cam position sensor that is disposed on the upper side of the cylinder head cover, and detects an axial position of the solid cam; and an air cleaner that is disposed on an upper side of the cylinder head cover, the motor, and the cam position sensor, and takes in and cleans the combustion air from outside. The intake system for the internal combustion engine is characterized in that a concave portion deeper than the other portions is formed in a bottom wall portion of the air cleaner, and that the concave portion is disposed between the motor and the cam position sensor.

The intake system for the internal combustion engine is characterized in that openings are formed in the bottom wall portion of the air cleaner so as to be arrayed in series, the opening communicating with each of the intake ports so as to be able to make the air flow, and that the concave portion is formed at a center in an array direction of the plurality of openings.

The intake system for the internal combustion engine is characterized in that the concave portion is disposed above the cam slide mechanism.

The intake system for the internal combustion engine further includes an intake pipe that connects each of the openings with each of the intake ports so as to be able to make the air flow, and is characterized in that the motor is disposed in a region surrounded by the air cleaner, the cylinder head cover, and the intake pipes.

The intake system for the internal combustion engine further includes the intake pipe that connects each of the openings with each of the intake ports so as to be able to make the air flow, and is characterized in that the cam position sensor is disposed in the region surrounded by the air cleaner, the cylinder head cover, and the intake pipes.

According to the present invention, a cross-sectional area of a center portion in a direction where the intake pipes are arrayed can be increased. Therefore, deviation of a cross-sectional shape can be eliminated, and variation of the air supplied to the intake pipes can be eliminated or suppressed.

DETAILED DESCRIPTION OF THE PREFERRED EMBODIMENTS

Hereinafter, an embodiment of the present invention will be described in detail with reference to drawings. In the following description, a configuration will be shown in which an intake system 9 for an internal combustion engine pertaining to the embodiment of the present invention is applied to a motorcycle 1. For simplicity of description, each direction of the intake system 9 for the internal combustion engine pertaining to the embodiment of the present invention and the motorcycle 1 is based on a direction of a rider who rides on the motorcycle 1. In each drawing, if needed, front of the intake system 9 for the internal combustion engine pertaining to the embodiment of the present invention and the motorcycle 1 is denoted by an arrow Fr, rear thereof by an arrow Rr, top by an arrow Tp, bottom by an arrow Bt, right by an arrow R, and left by an arrow L.

Figure 1:
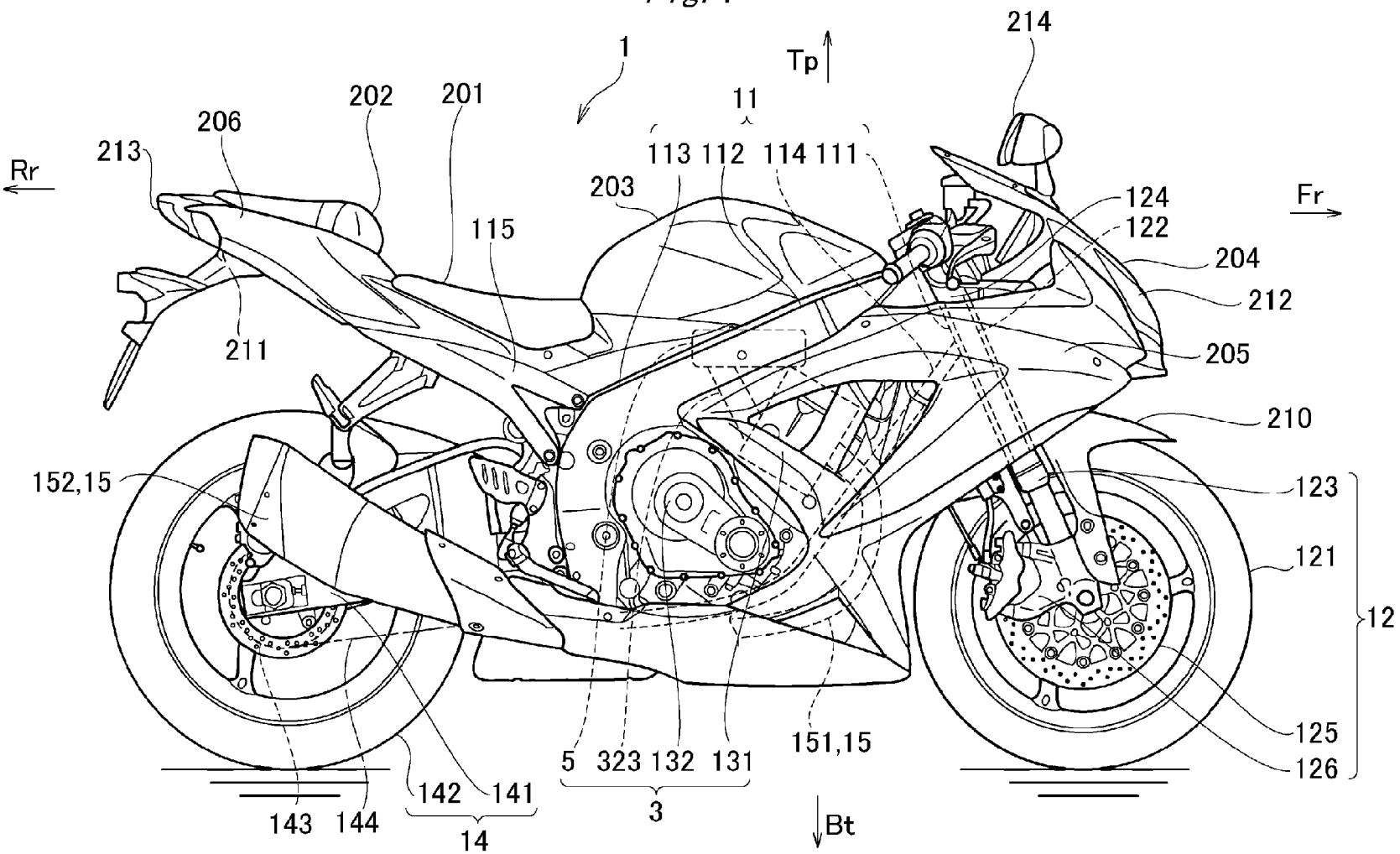
FIG. 1 is a right side view schematically showing a configuration of a motorcycle to which an intake system for an internal combustion engine pertaining to an embodiment of the present invention is applied.

First, there will be described an overall configuration of the motorcycle 1 to which the intake system 9 for the internal combustion engine pertaining to the embodiment of the present invention is applied (hereinafter simply referred to as the motorcycle 1) with reference to FIG. 1. FIG. 1 is a right side view schematically showing the configuration of the motorcycle 1. As shown in FIG. 1, the motorcycle 1 has: a motorcycle body frame 11; a steering gear 12; an engine unit 13 as the internal combustion engine; and a rear wheel suspension 14. The intake system 9 for the internal combustion engine pertaining to the embodiment of the present invention is then applied to the engine unit 13.

The motorcycle body frame 11 is configured to include: a steering head pipe 111; a matched pair of main frames 112; a pivot bracket 113; down frames 114; and a seat rail 115. The motorcycle body frame 11 is, for example, formed of an iron-based material or aluminum alloy, and is integrally joined by welding etc. The steering head pipe 111 is formed as a tubular shape tilted to the rear. The matched pair of main frames 112 extends from a rear portion of the steering head pipe 111 toward diagonally backward lower right and diagonally backward lower left, respectively. The pivot bracket 113 is provided in the rear of each of the matched pair of main frames 112, and extends so as to curve substantially downward. The matched pair of down frames 114 has portions that extend from the rear portion of the steering head pipe 111 toward a downside of the matched pair of main frames 112, and portions that extend substantially rearward from lower ends of these portions. Additionally, rear ends of the matched pair of down frames 114 are joined to the pivot bracket 113, respectively. The seat rail 115 extends diagonally backward upward from an upper portion of the pivot bracket 113. It is to be noted that since a part of the motorcycle body frame 11 is hidden with cover members 204, 205, and 206, and cannot be seen from outside, it is shown with a dashed line in FIG. 1.

The steering gear 12 is provided at a front portion of the motorcycle body frame 11 rotatably with respect to the motorcycle body frame 11. The steering gear 12 is configured to include: a front wheel 121; a steering shaft 122; a matched pair of front forks 123; and a handle 124.

The steering shaft 122 is rotatably supported by the steering head pipe 111. The matched pair of front forks 123 is arranged on right and left sides of the steering shaft 122. The front wheel 121 is rotatably supported by lower ends of the matched pair of front forks 123. A brake disc 125 is provided at the front wheel 121 so as to integrally rotate. Additionally, a brake rim 126 that acts on the brake disc 125 is provided at the matched pair of front forks 123. The handle 124 is provided at an upper end of the steering shaft 122 and the matched pair of front forks 123. The handle 124 has right and left hand grips. A throttle grip and a brake lever for operating the brake rim 126 of the front wheel 121 are provided at the right handle grip. A clutch lever for operating a clutch is provided at the left handle grip. Furthermore, a meter unit and switches (both are abbreviated in FIG. 1) for operating lights are provided at the handle 124 and a vicinity thereof.

The engine unit 13 as the internal combustion engine is arranged in a region surrounded by the main frame 112, the down frame 114, and the pivot bracket 113 of the motorcycle body frame 11. The engine unit 13 includes a cylinder assembly 131 and a crankcase assembly 132.

In the cylinder assembly 131, formed are: a plurality of combustion chambers 311 (cylinders); a plurality of intake ports 321 through which the air-fuel mixture of fuel and the air is introduced into each combustion chamber 311; and a plurality of exhaust ports 322 through which exhaust gas is introduced out of each combustion chamber 311. A piston 312 is reciprocatably disposed inside each combustion chamber 311. Furthermore, the cylinder assembly 131 has: an air cleaner 5 that takes in and cleans the combustion air; an intake pipe 323 that mixes fuel to the air cleaned by the air cleaner 5, and supplies to each intake port 321; and a valve apparatus 35 (mentioned later) that opens and closes between each intake pipe 323 and each combustion chamber 311. Additionally, the intake system 9 for the internal combustion engine pertaining to the embodiment of the present invention is configured by the air cleaner 5, the intake pipe 323, and the valve apparatus 35 provided at the cylinder assembly 131. As described above, the intake system 9 for the internal combustion engine pertaining to the embodiment of the present invention takes in, cleans, and supplies the combustion air from outside to each combustion chamber 311. It is to be noted that details of the intake system 9 for the internal combustion engine pertaining to the embodiment of the present invention will be mentioned later.

A crankshaft, a counter shaft, a driven shaft, a transmission, and a clutch are provided at the crankcase assembly 132 (all are hidden and cannot be seen in FIG. 1). The crankshaft, the counter shaft, and the driven shaft are disposed respectively rotatably and in parallel to one another inside the crankcase assembly 132. The crankshaft is coupled to each piston 312 disposed in the combustion chamber 311 by a con rod. The crankshaft and the counter shaft are coupled so as to be able to intermit rotational power by the clutch. The transmission is configured between the crankshaft and the driven shaft. One end of the driven shaft protrudes to a left rear portion of the crankcase assembly 132. Additionally, a drive sprocket is provided at the one end of the driven shaft.

The rear wheel suspension 14 includes: a swing arm 141; a shock absorber (it is hidden and cannot be seen in FIG. 1); and a rear wheel 142. The rear wheel suspension 14 is provided at a rear portion of the pivot bracket 113 of the motorcycle body frame 11, and is coupled to the pivot bracket 113 rockably in a vertical direction. The shock absorber is provided between the swing arm 141 and the pivot bracket 113 or the seat rail 115, and absorbs and relieves vibration, impact, etc. that are transmitted to the pivot bracket 113 or the seat rail 115 from the swing arm 141. The rear wheel 142 is rotatably supported by a rear end of the swing arm 141. A driven sprocket 143 is provided on the left side of the rear wheel 142 so as to integrally rotate. A chain 144 is wound around the drive sprocket of the engine unit 13, and the driven sprocket 143 of the rear wheel 142. Additionally, rotational power of the engine unit 13 is transmitted to the rear wheel 142 by the chain 144.

An exhaust apparatus 15 includes a silencer 152 and an exhaust pipe 151. The silencer 152 is arranged in the rear of the engine unit 13 and yet at the side of the rear wheel 142. One end portion (front end portion) of the exhaust pipe 151 is connected to the exhaust port 322 of the cylinder assembly 131 of the engine unit 13. The other end portion (rear end portion) of the exhaust pipe 151 is connected to a front side of the silencer 152. Additionally, the exhaust pipe 151 extends toward the front from a front side of the cylinder assembly 131 of the engine unit 13, curves rearward in the front of the cylinder assembly 131, passes through a side or a downside of the cylinder assembly 131, and reaches the front side of the silencer 152.

A seat 201 (rider's seat) on which a rider sits, and a seat 202 (tandem seat) on which a fellow passenger sits are removably attached on an upper side of the seat rail 115. A lock mechanism (abbreviated in FIG. 1) for fixing the seats 201 and 202 to the seat rail 115 is provided at the seats 201 and 202, and the seat rail 115. A fuel tank 203 is provided on an upper side of the matched pair of main frames 112 and yet on a front side of the seats 201 and 202. Furthermore, cover members 204, 205, and 206 for covering outside are provided at the motorcycle 1. In the cover members 204, 205, and 206, included are: a front cover 204 for covering a front portion of the motorcycle 1; a side cover 205 for covering a side thereof; and a rear cover 206 for covering a rear portion thereof. The cover members 204, 205, and 206 are removably attached to the motorcycle body frame 11, the front fork 123, etc. The cover members 204, 205, and 206 are shell-like members, and are, for example, formed of a synthetic resin material etc. Additionally, the cover members 204, 205, and 206 configure a design of an appearance of the motorcycle 1 by covering the outside of the motorcycle 1.

Furthermore, at the motorcycle 1, provided are: a front fender 210 for covering an upper side of the front wheel 121; a rear fender 211 for covering an upper side of the rear wheel 142; a head light 212; a tail light 213; a blinker; a rearview mirror 214; etc.

Figure 2:
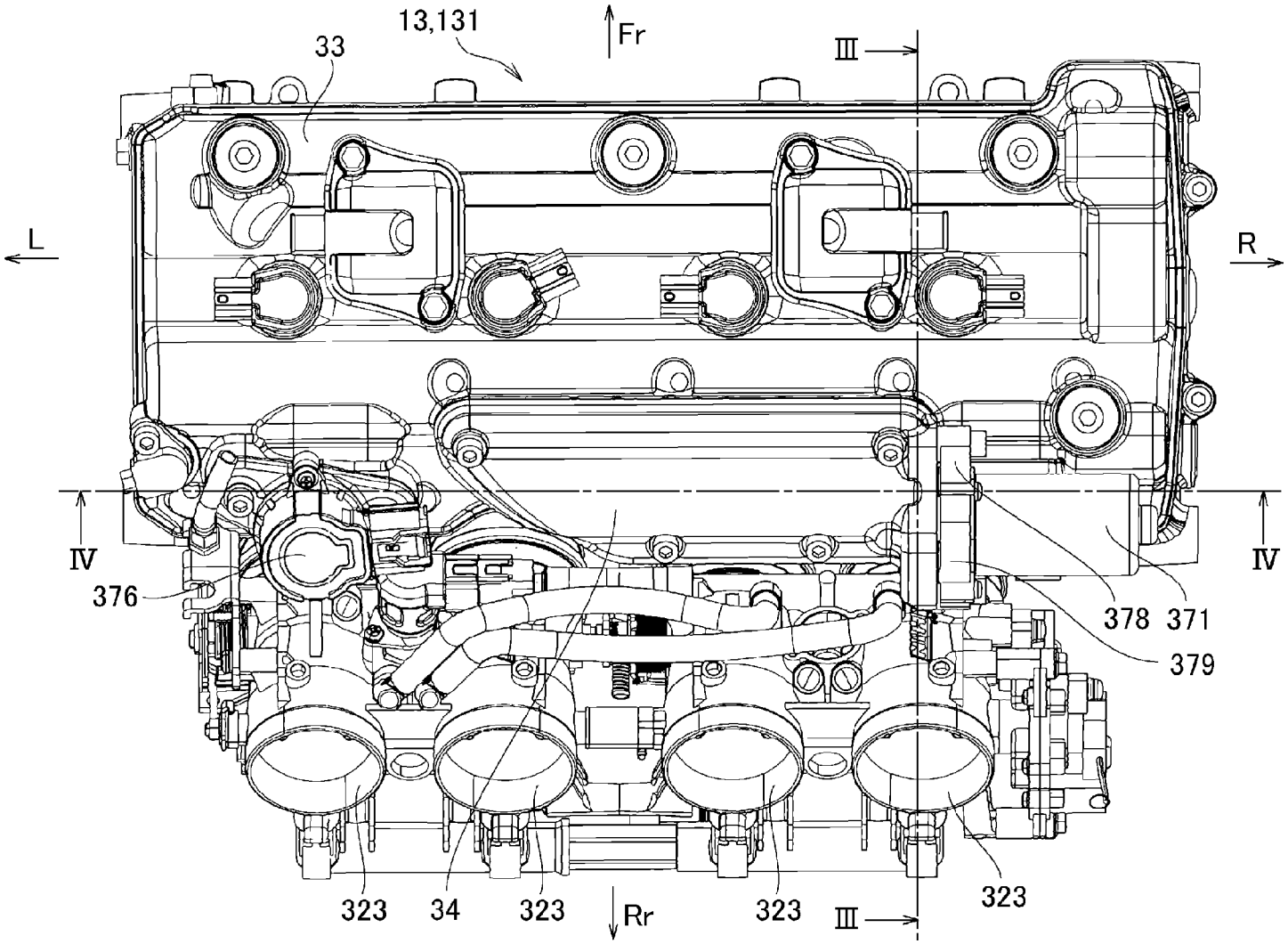
FIG. 2 is a plan view showing a configuration of a cylinder assembly of an engine unit to which the intake system for the internal combustion engine pertaining to the embodiment of the present invention is applied, the plan view being seen from above.
Figure 3:
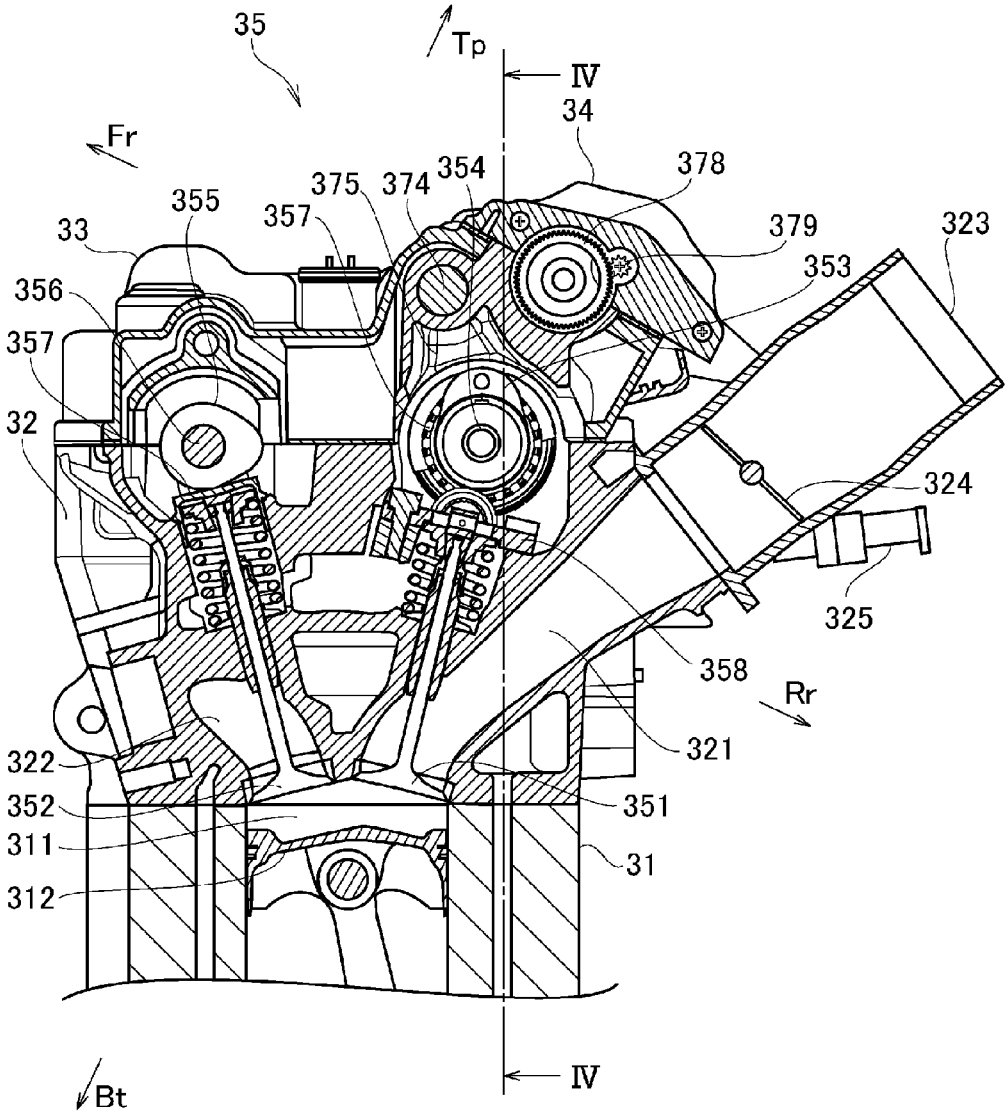
FIG. 3 is a view schematically showing a configuration of a valve apparatus provided at a cylinder assembly of an engine unit, the view being a cross-sectional view taken along a line III-III of FIG. 2.
Figure 4:
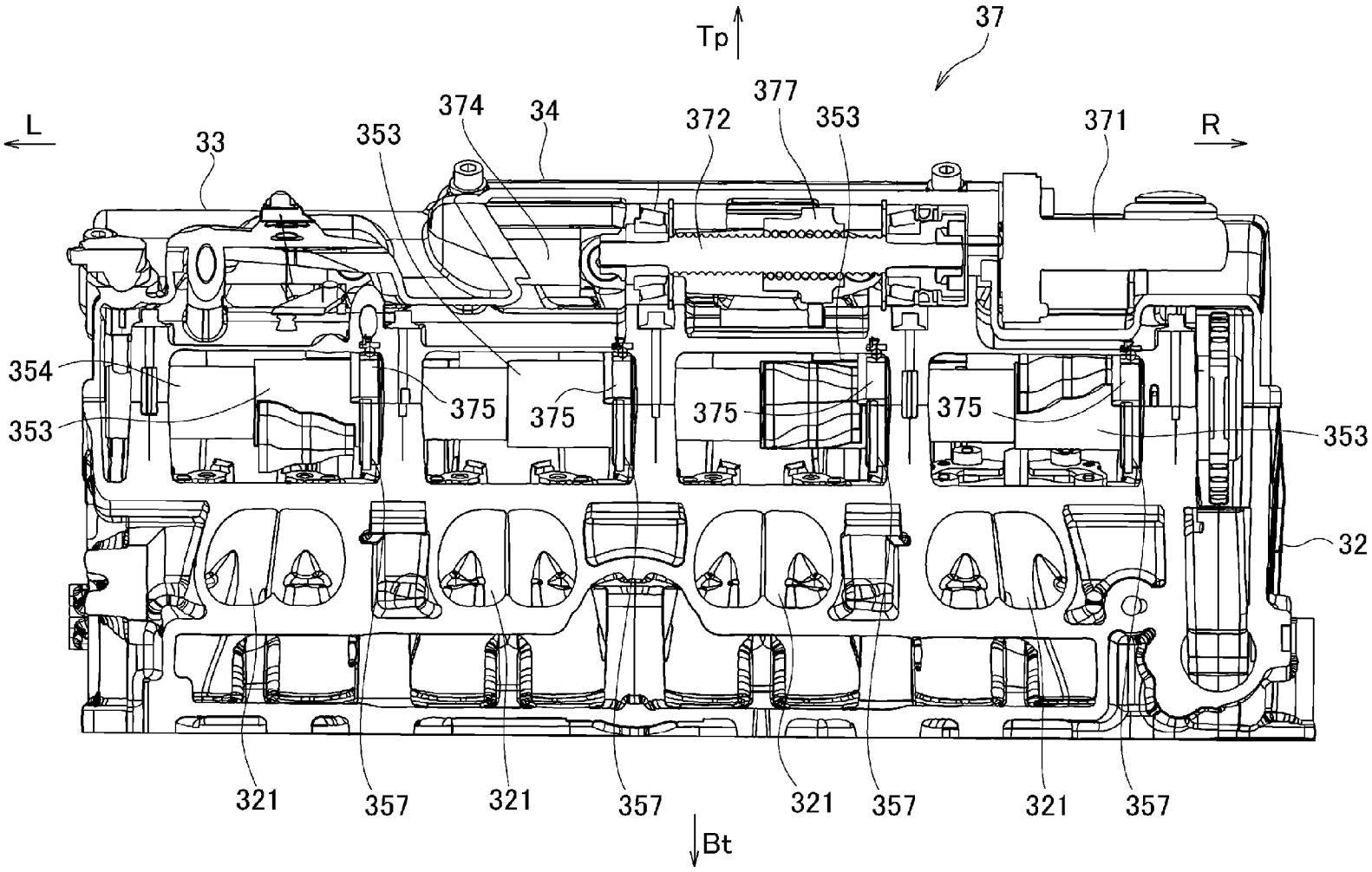
FIG. 4 is a view schematically showing the configuration of the valve apparatus provided at the cylinder assembly of the engine unit, the view being a cross-sectional view taken along a line IV-IV of FIGS. 2 and 3.

Next, there will be described a configuration of the cylinder assembly 131 of the engine unit 13 with reference to FIGS. 2 to 4. FIG. 2 is a plan view showing the configuration of the cylinder assembly 131 of the engine unit to which the intake system 9 for the internal combustion engine pertaining to the embodiment of the present invention is applied, the plan view being seen from above. FIG. 3 is a view schematically showing a configuration of the valve apparatus 35 provided at the cylinder assembly 131 of the engine unit 13, the view being a cross-sectional view taken along a line III-III of FIG. 2. FIG. 4 is a view schematically showing the configuration of the valve apparatus 35 provided at the cylinder assembly 131 of the engine unit, the view being a cross-sectional view taken along a line IV-IV of FIGS. 2 and 3. As shown in FIGS. 2 to 4, the cylinder assembly 131 has: a cylinder block 31; a cylinder head 32; a cylinder head cover 33; a ball screw housing 34; a motor 371; and a cam position sensor 376.

The plurality of combustion chambers 311 (cylinders) are formed inside the cylinder block 31 (particularly, refer to FIG. 3). For example, a so-called in-line four-cylinder gasoline engine is applied to the engine unit 13. Additionally, the four combustion chambers 311 are formed inside the cylinder block 31 so as to align in series in a predetermined direction (a horizontal direction of the motorcycle 1 in the embodiment, i.e., a direction perpendicular to paper in FIG. 3). Additionally, the piston 312 reciprocates inside each combustion chamber 311 (particularly, refer to FIG. 3). It is to be noted that the number of combustion chambers 311 formed in the engine unit 13 is one example, and an application target of the present invention is not limited to an in-line four-cylinder engine.

The cylinder head 32 is attached on an upper side of the cylinder block 31. In the cylinder head 32, for each combustion chamber 311, formed are two intake ports 321 through which the air-fuel mixture of the air and fuel is introduced into the combustion chamber 311, and two exhaust ports 322 through which exhaust gas is introduced out of combustion chamber 311. Additionally, the valve apparatus 35 is provided at the cylinder head 32 (particularly, refer to FIGS. 3 and 4). The valve apparatus 35 has: an intake valve 351 that opens and closes between each combustion chamber 311 and each intake port 321; an exhaust valve 352 that opens and closes between each combustion chamber 311 and each exhaust port 322; and a drive mechanism that drives these intake valve 351 and exhaust valve 352 (details will be mentioned later). The intake pipe 323 is connected to each intake port 321 (particularly, refer to FIGS. 2 and 3). Each intake pipe 323 has a pipe-shaped configuration that extends substantially upward from the cylinder head 32. At each intake pipe 323, provided are a throttle valve 324 that adjusts a flow rate of the air, and a fuel injection valve 325 that mixes fuel with the air.

The cylinder head cover 33 is removably attached on an upper side of the cylinder head 32. An opening is formed in the cylinder head cover 33, and the ball screw housing 34 that occludes the opening is removably attached to the cylinder head cover 33. Additionally, the drive mechanism of the valve apparatus 35 is housed in a space surrounded by the cylinder head 32 and the cylinder head cover 33. It is to be noted that the space is sealed by the cylinder head cover 33 and the ball screw housing 34.

Here, a configuration of the valve apparatus 35 will be described. The valve apparatus 35 has: the intake valve 351; an intake side cam 353 that drives each intake valve 351; an intake side cam shaft 354 in which each intake valve 351 is provided; the exhaust valve 352; an exhaust side cam 355 that drives each exhaust valve 352; and an exhaust side cam shaft 356 in which each exhaust valve 352 is provided (particularly, refer to FIG. 3). In the embodiment, a configuration will be shown in which a solid cam is applied to the intake side cam 353, and a plate cam is applied to the exhaust side cam 355. Therefore, the valve apparatus 35 further includes a cam slide mechanism 37 (details will be mentioned later) that reciprocates the intake side cam 353 in an axial direction. It is to be noted that a configuration may be employed in which the solid cam is applied also to the exhaust side cam 355. In this case, the valve apparatus 35 further includes the cam slide mechanism 37 that reciprocates the exhaust side cam 355 in the axial direction.

The intake side cam shaft 354 is provided above the intake valve 351 in parallel with an array direction of the combustion chamber 311 (horizontal direction of the motorcycle 1) (particularly, refer to FIGS. 3 and 4). Similarly, the exhaust side cam shaft 356 is provided above the exhaust valve 352 in parallel with the array direction of the combustion chamber 311 (particularly, refer to FIG. 3). Additionally, the intake side cam shaft 354 and the exhaust side cam shaft 356 are respectively rotatably supported by the cylinder head 32 and the cylinder head cover 33 through shaft bushes, such as a bearing.

The predetermined number of intake side cams 353 is provided at the intake side cam shaft 354 (particularly, refer to FIGS. 3 and 4). The intake side cam 353 is a solid cam in which a shape of a cam curve varies in the axial direction of the intake side cam shaft 354. Specifically, the cam curve of the intake side cam 353 has a gradually increasing (or decreasing) cam rise from one end to the other end of the axial direction of the intake side cam shaft 354. Additionally, each intake side cam 353 (solid cam) can move in the axial direction with respect to the intake side cam shaft 354. However, each intake side cam 353 cannot rotate relatively to the intake side cam shaft 354, and rotates integrally with the intake side cam shaft 354. In addition, a bearing 357 is attached to one end in the axial direction of each intake side cam 353. Each bearing 357 moves in the axial direction integrally with each intake side cam 353.

The predetermined number of exhaust side cams 355 is provided at the exhaust side cam shaft 356. A plate cam is applied to each exhaust side cam 355 (particularly, refer to FIG. 3).

For example, a roller type intake side tappet 358 is disposed between an upper end portion of the intake valve 351 (upper end portion of a valve stem) and each intake side cam 353 (particularly, refer to FIGS. 3 and 4). These intake side tappets 358 are guided reciprocatably in a same direction as the intake valve 351 by a tappet guide (abbreviated in FIGS. 2 to 4). Meanwhile, for example, a direct attack type exhaust side tappet 359 is disposed between an upper end portion of the exhaust valve 352 (upper end portion of the valve stem) and each exhaust side cam 355 (particularly, refer to FIG. 3). These exhaust side tappets 359 are also guided reciprocatably in a same direction as the exhaust valve 352 by the tappet guide (abbreviated in FIGS. 2 to 4).

Figure 6A:
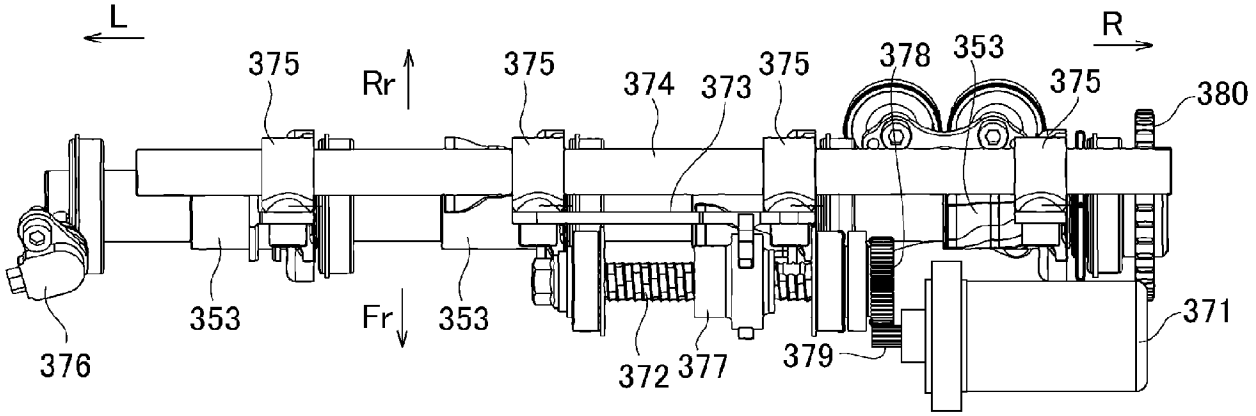
FIG. 6A is a view when the cam slide mechanism of the valve apparatus is extracted from the cylinder assembly and is seen from above.
Figure 6B:
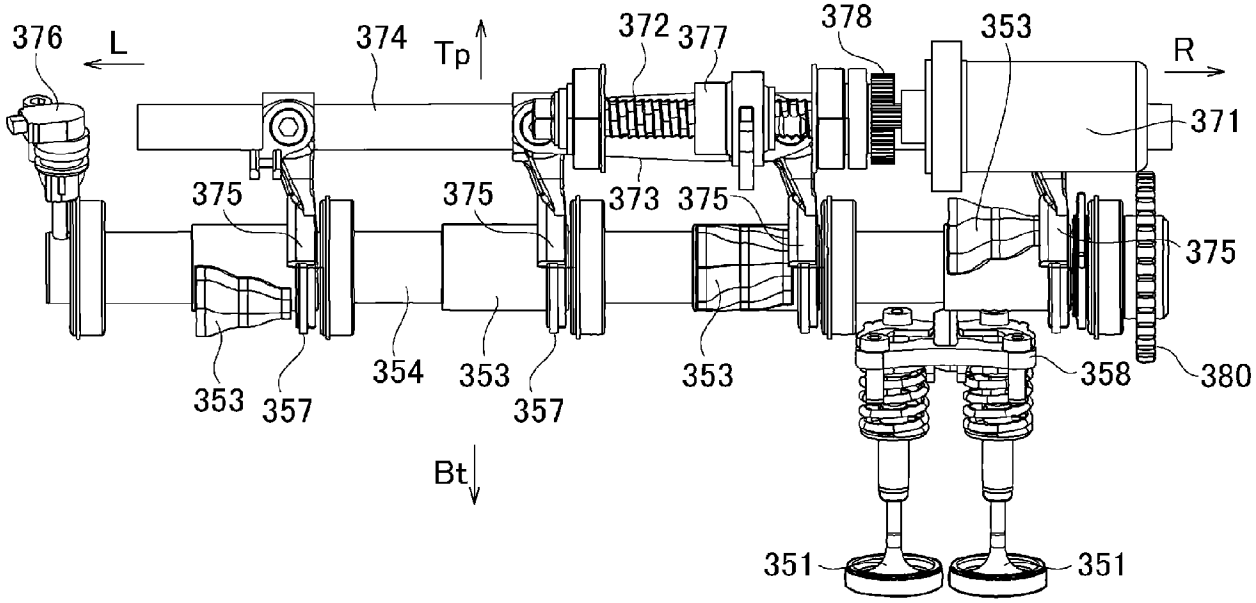
FIG. 6B is a view when the cam slide mechanism of the valve apparatus is extracted from the cylinder assembly and is seen from the rear.

A driven sprocket 380 is provided at one end of each of the intake side cam shaft 354 and the exhaust side cam shaft 356 (refer to FIGS. 6A and 6B, and the exhaust side cam shaft is abbreviated in FIGS. 2 to 4). Additionally, a cam chain (abbreviated in FIGS. 2 to 4) is wound around these driven sprockets 380 and the drive sprocket provided at one end of the crankshaft.

With such configuration, the intake side cam shaft 354 and the exhaust side cam shaft 356 rotate in synchronization with the crankshaft. Additionally, when the intake side cam shaft 354 and the exhaust side cam shaft 356 rotate, the intake side cam 353 pushes down the upper end of the intake valve 351 at predetermined timing through the intake side tappet 358. Similarly, the exhaust side cam 355 pushes down the upper end of the exhaust valve 352 at predetermined timing through the exhaust side tappet 359. It is to be noted that lift timing and a lift amount of the intake valve 351 by the intake side cam 353, and lift timing and a lift amount of the exhaust valve 352 by the exhaust side cam 355 (i.e., cam curves) are appropriately set.

Figure 5:
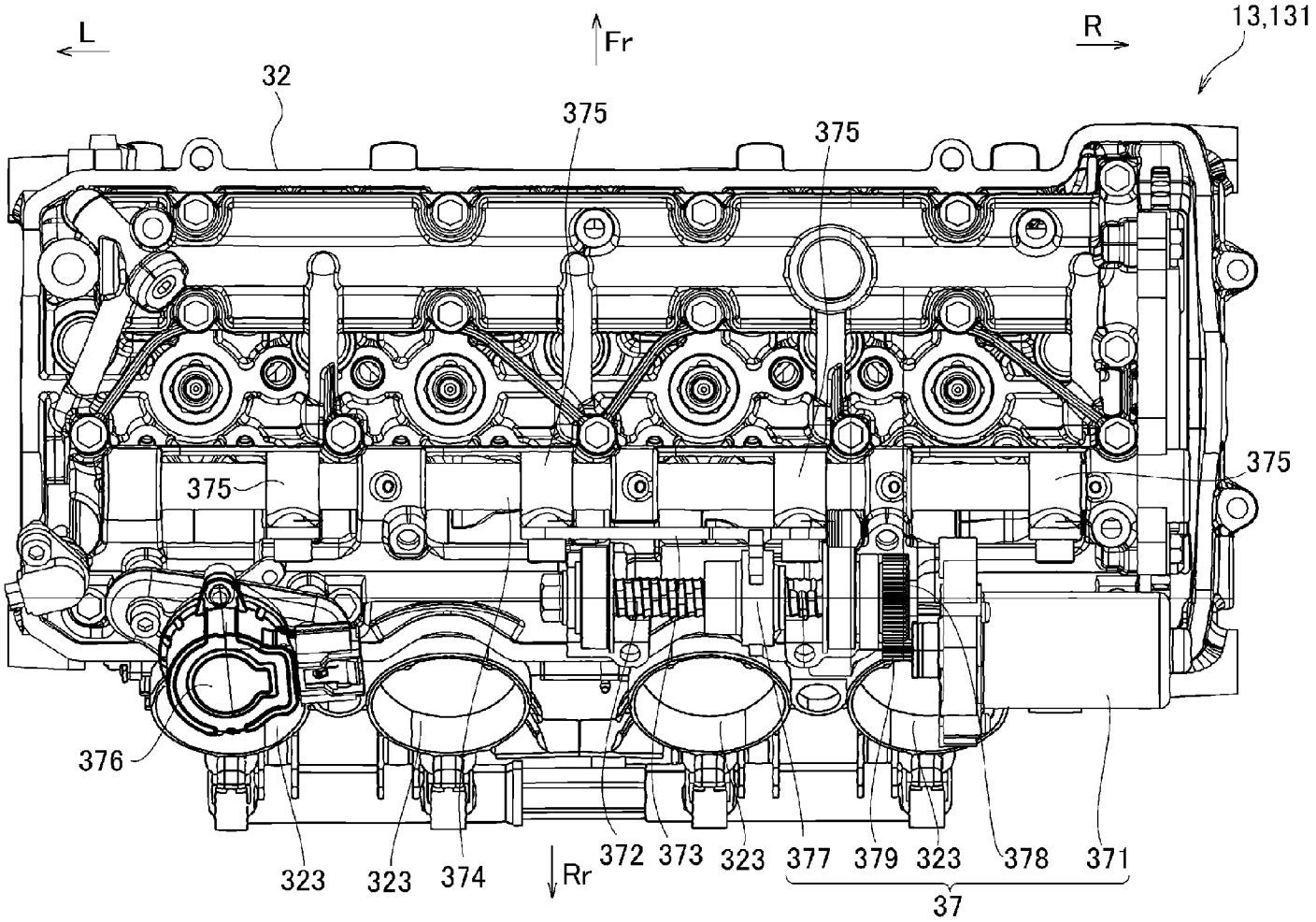
FIG. 5 is a view schematically showing a configuration of a cam slide mechanism of the valve apparatus, the view showing a state where a cylinder head cover is removed from a cylinder head.

The valve apparatus 35 has the cam slide mechanism 37 for moving the intake side cam 353 in the axial direction of the intake side cam shaft 354. Here, the cam slide mechanism 37 will be described with reference to FIGS. 5, 6, etc. FIG. 5 is a view schematically showing a configuration of the cam slide mechanism 37 of the valve apparatus 35, the view showing a state where the cylinder head cover 33 is removed from the cylinder head 32. FIG. 6A is a view when the cam slide mechanism 37 of the valve apparatus 35 is extracted from the cylinder assembly 131 and is seen from above, and FIG. 6B is a view when the cam slide mechanism 37 of the valve apparatus 35 is extracted from the cylinder assembly 131 and is seen from the rear.

As shown in FIGS. 5, 6A, and 6B, the cam slide mechanism 37 has: the motor 371 as a drive source; a ball screw 372; a slide nut 377; a base plate 373; a cam fork shaft 374; a cam fork 375; and the cam position sensor 376.

The motor 371 as the drive source is, as shown in FIG. 5, provided on an upper side of the cylinder head cover 33, and yet at one side end in a horizontal direction (axial direction of the intake side cam shaft 354) of the cylinder head cover 33 or at a vicinity of the one side end. For example, the motor 371 is provided so as to be adjacent in a horizontal direction of the ball screw housing 34 (refer to FIG. 2). Furthermore, the motor 371 is provided at a position deviated on an intake port 321 (intake pipe 323) side (rear side) in relation to a front-rear direction.

The ball screw 372 is disposed in parallel with the intake side cam shaft 354. The ball screw 372 is rotatably supported by the cylinder head cover 33 and the ball screw housing 34 through the shaft bushes, such as the bearing. The ball screw 372 rotates by rotational power of the motor 371. For example, a driven gear 378 is provided at one end of the ball screw 372, and the gear meshes with a drive gear 379 provided at a rotating shaft of the motor 371.

The slide nut 377 has meshed with the ball screw 372. Additionally, the slide nut 377 moves in an axial direction (horizontal direction) of the ball screw 372 along with rotation of the ball screw 372. The cam fork shaft 374 is provided in parallel with the intake side cam shaft 354. The cam fork shaft 374 is supported reciprocatably in the axial direction by the cylinder head cover 33. Additionally, the slide nut 377 and the cam fork shaft 374 are combined with each other so as to integrally reciprocate through the base plate 373.

The cam fork 375 is provided at the cam fork shaft 374 (refer to FIG. 3). The cam fork 375 has an arm-like or a plate-like configuration of projecting from the cam fork shaft 374 toward each intake side cam 353. A tip portion of each cam fork 375 engages with an outer ring of the bearing 357 provided at each intake side cam 353. For example, a groove extending in a circumferential direction of the bearing 357 provided at each intake side cam 353 is formed at the tip portion of the cam fork 375. Additionally, the outer ring of each bearing 357 fits in the groove.

The cam position sensor 376 detects an axial position of each intake side cam 353. The cam position sensor 376 is provided at the other one side end in the horizontal direction of the cylinder head cover 33 (the other one side end in the axial direction of the intake side cam shaft 354, and yet an end portion on an opposite side of a side where the motor 371 is provided), or at a vicinity of the other one side end. Furthermore, the cam position sensor 376 is, similarly to the motor 371, provided at a position deviated on the intake port 321 side in relation to the front-rear direction. Additionally, the motor 371 and the cam position sensor 376 are provided at positions mutually overlapped in a side view from the horizontal direction.

According to the cam slide mechanism 37 of such configuration, the ball screw 372 rotates by the rotational power of the motor 371, and the slide nut 377 moves in the axial direction along with rotation of the ball screw 372. Additionally, each cam fork 375 moves in the axial direction in a state of being integrated with the slide nut 377, the base plate 373, and the cam fork shaft 374. As a result, each intake side cam 353 is moved in the axial direction of the intake side cam shaft 354 by the cam fork 375. As described above, the cam slide mechanism 37 can move each intake side cam 353 in the axial direction of the intake side cam shaft 354 by drive force of the motor 371. Additionally, the cam slide mechanism 37 moves each intake side cam 353 in the axial direction, and thereby the lift timing and the lift amount of the intake valve 351 can be changed steplessly.

At the time of operating the engine unit 13, when the rider handles an accelerator grip of the motorcycle 1, the motor 371 is actuated, the ball screw 372 rotates, and the slide nut 377 moves in the axial direction. Along with the movement of the slide nut 377, the cam fork 375 then moves, and the intake side cam 353 moves by the cam fork 375. For example, in a state where the number of engine revolutions is low, a position of the intake side cam 353 where a cam rise is low is in contact with the intake side tappet 358. When the rider handles the accelerator grip so that an opening of the throttle valve 324 becomes larger, the intake side cam 353 moves toward one side in the axial direction by the drive force of the motor 371. A position of the intake side cam 353 where the cam rise is high then gets contact with the intake side tappet 358. As a result of this, the lift amount becomes larger. Meanwhile, when the rider handles the accelerator grip so that the opening of the throttle valve 324 becomes smaller, the intake side cam 353 moves toward the other side in the axial direction by the drive force of the motor 371. The position of the intake side cam 353 where the cam rise is low then gets contact with the intake side tappet 358. As a result of this, the lift amount becomes smaller.

Figure 7:
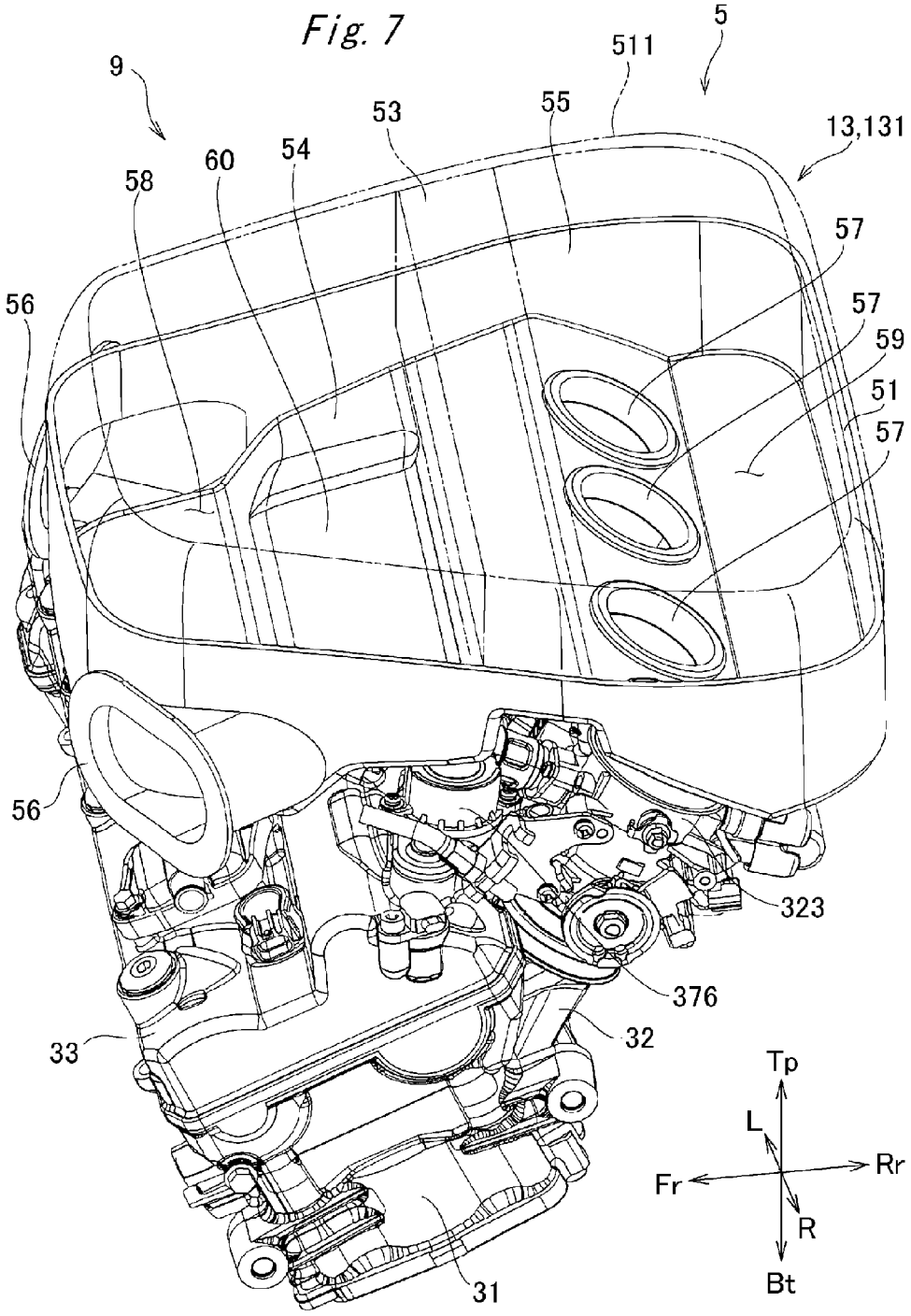
FIG. 7 is an external perspective view schematically showing a state where an air cleaner is attached to the cylinder assembly.
Figure 8:
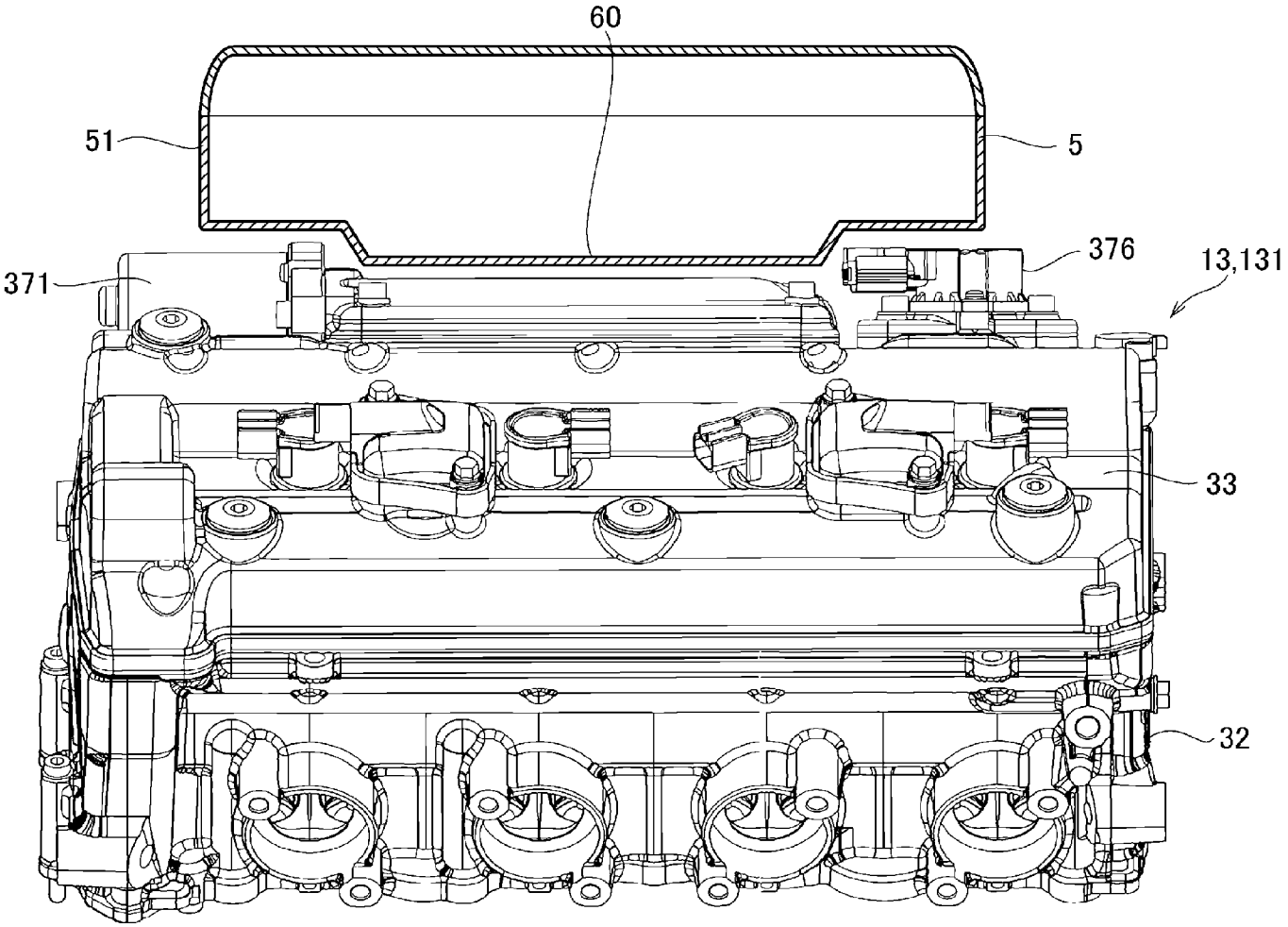
FIG. 8 is a plan view schematically showing the state where the air cleaner is attached to the cylinder assembly.
Figure 9:
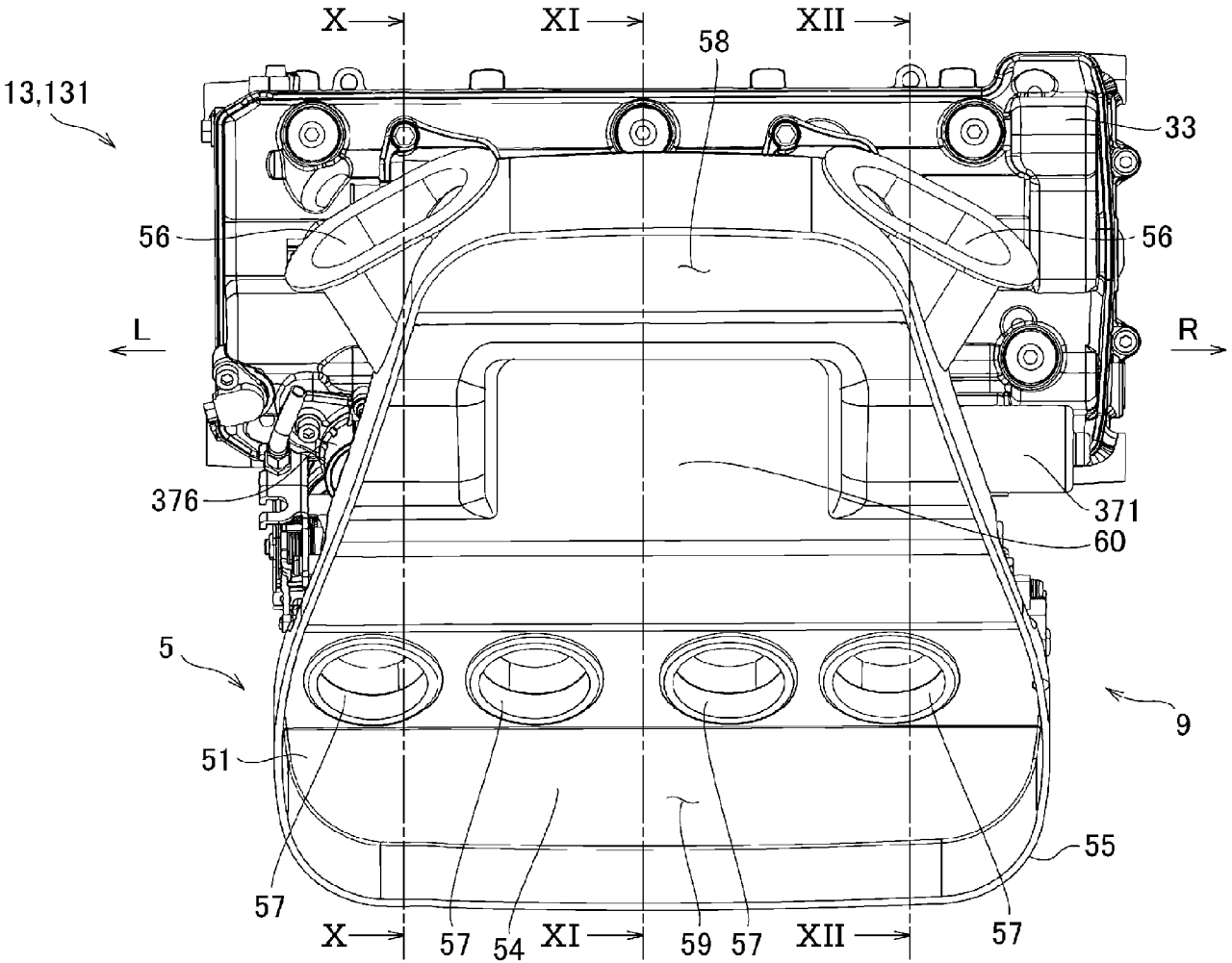
FIG. 9 is a view showing a relation between the cam slide mechanism of the valve apparatus and the air cleaner, the view being a view when the cylinder assembly to which the air cleaner has been attached is seen from the front.
Figure 10:
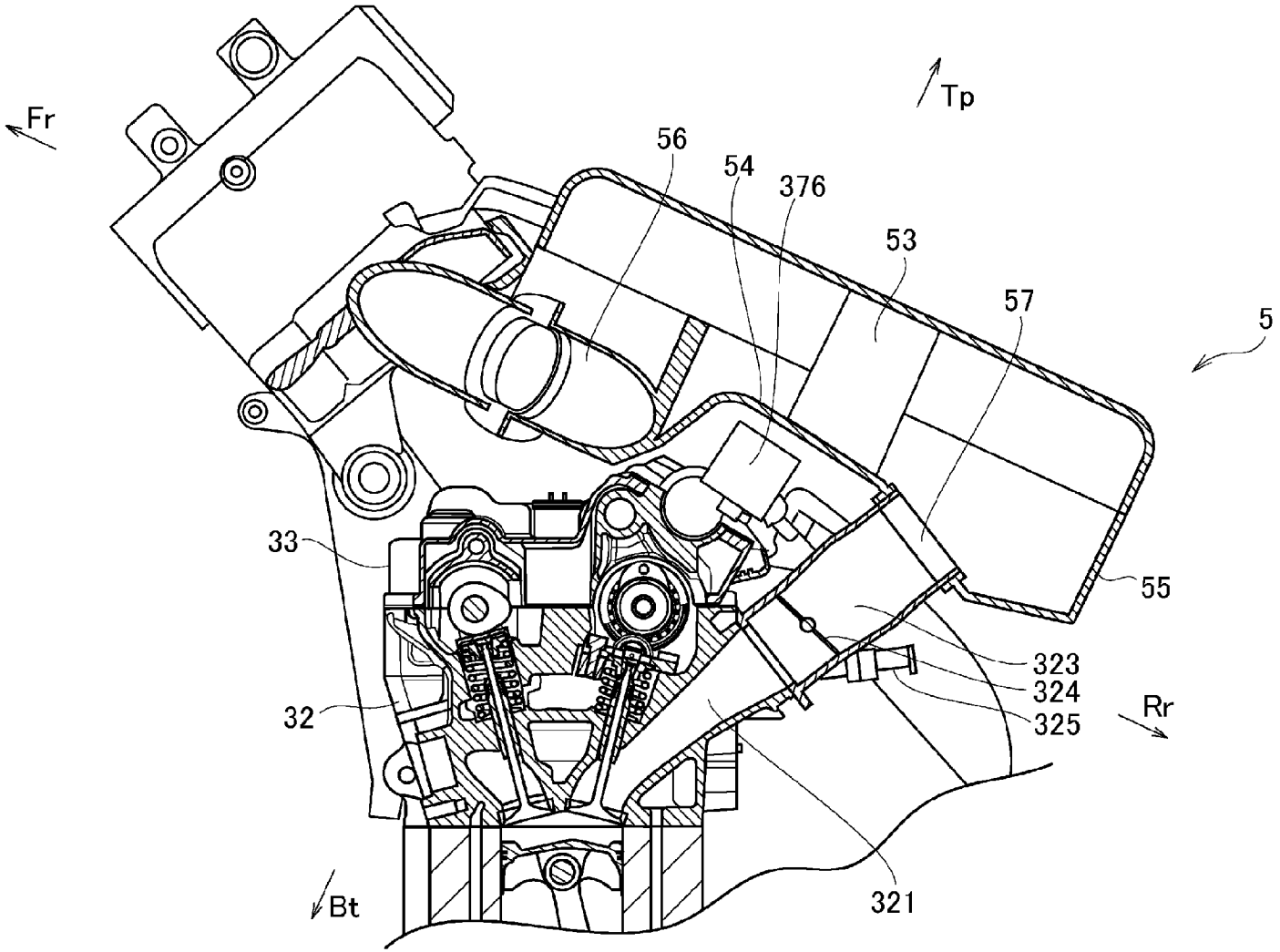
FIG. 10 is a view showing the relation between the cam slide mechanism of the valve apparatus and the air cleaner, the view being a cross-sectional view taken along a line X-X of FIG. 9.
Figure 11:
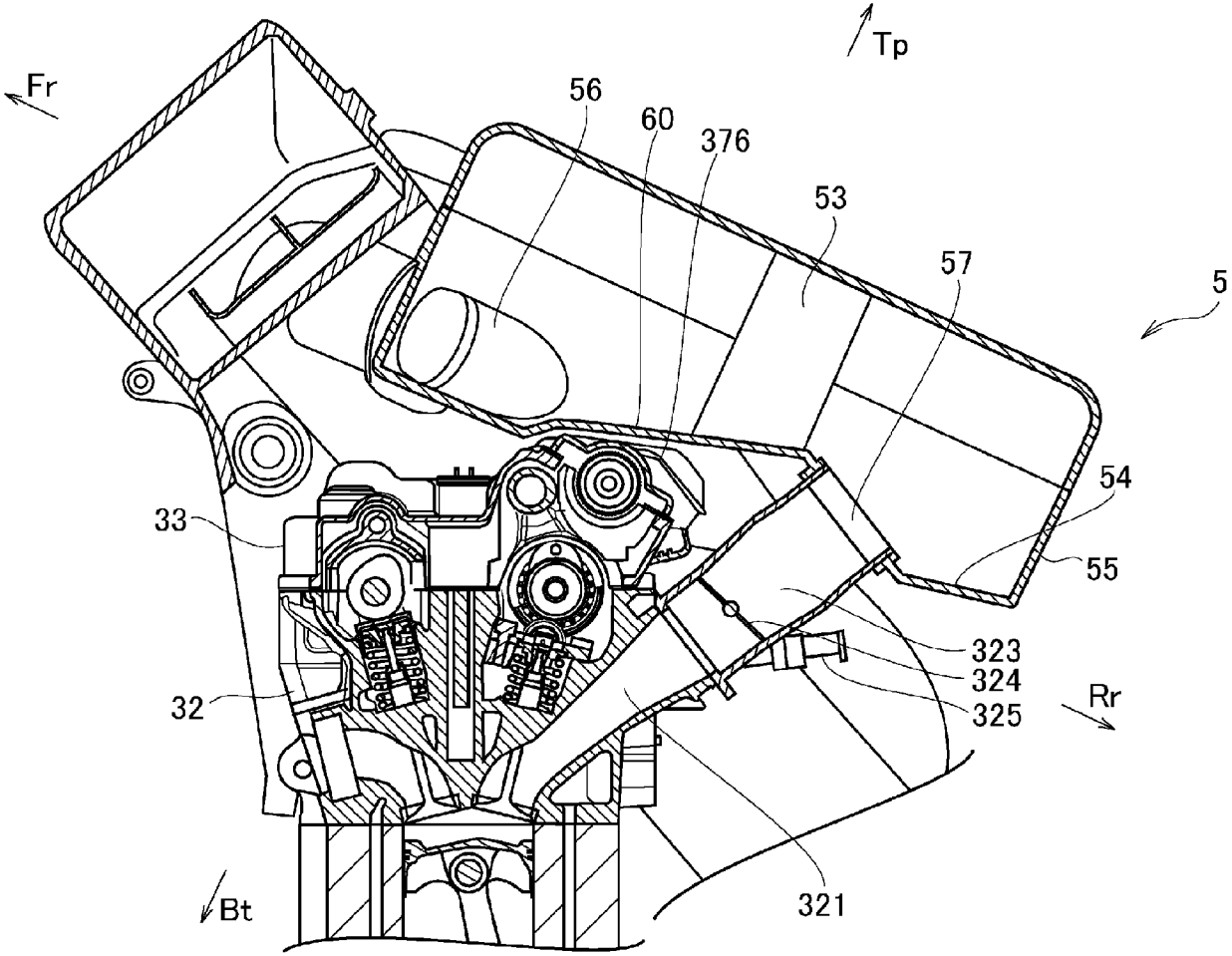
FIG. 11 is a view showing the relation between the cam slide mechanism of the valve apparatus and the air cleaner, the view being a cross-sectional view taken along a line XI-XI of FIG. 9.
Figure 12:
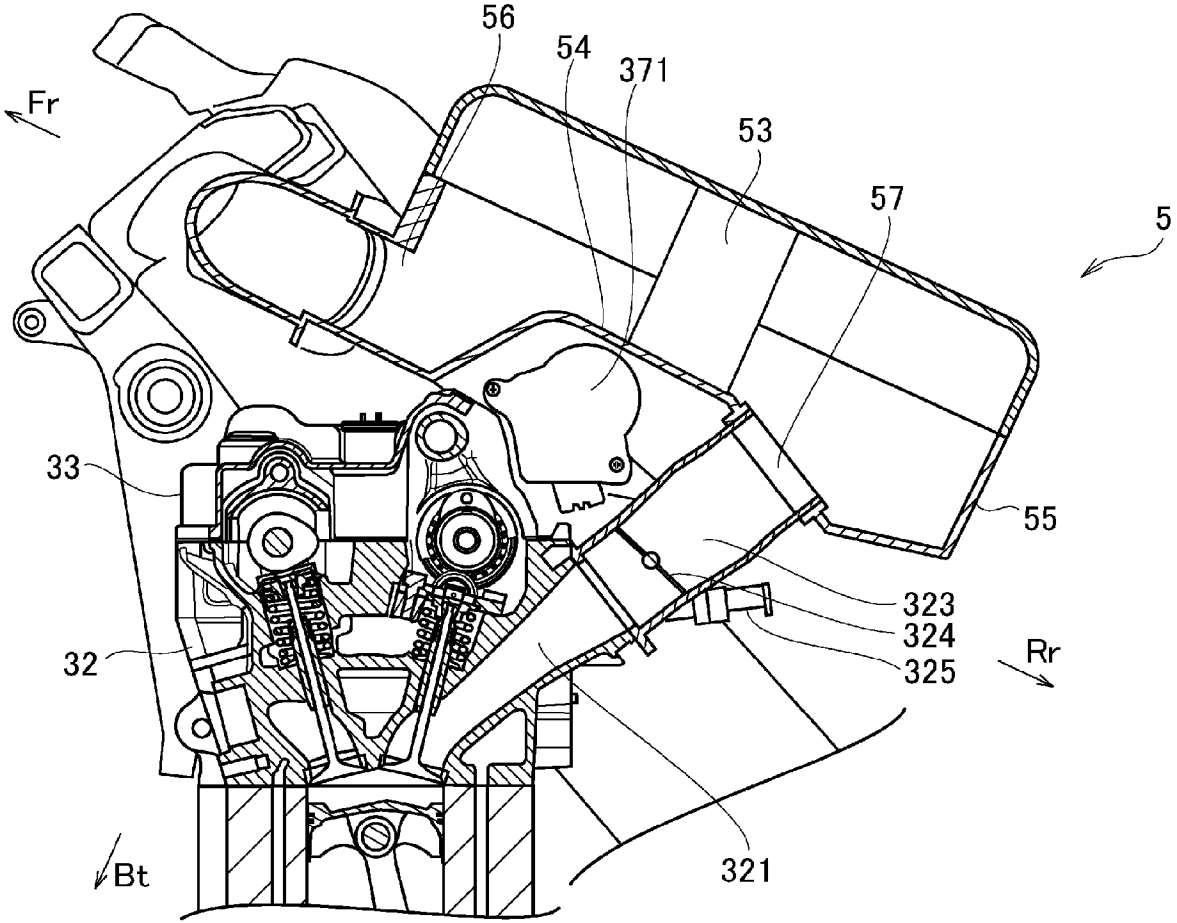
FIG. 12 is a view showing the relation between the cam slide mechanism of the valve apparatus and the air cleaner, the view being a cross-sectional view taken along a line XII-XII of FIG. 9.

Next, there will be described the intake system 9 for the internal combustion engine pertaining to the embodiment of the present invention with reference to FIGS. 7 to 12. The intake system 9 for the internal combustion engine pertaining to the embodiment of the present invention has: the air cleaner 5; the intake pipe 323; and the valve apparatus 35. FIG. 7 is an external perspective view schematically showing a state where the air cleaner 5 is attached to the cylinder assembly 131. FIG. 8 is a plan view schematically showing the state where the air cleaner 5 is attached to the cylinder assembly 131. FIG. 9 is a view showing a relation between the cam slide mechanism 37 of the valve apparatus 35 and the air cleaner 5, the view being a view when the cylinder assembly 131 to which the air cleaner 5 has been attached is seen from the front. FIG. 10 is a view showing the relation between the cam slide mechanism 37 of the valve apparatus 35 and the air cleaner 5, the view being a cross-sectional view taken along a line X-X of FIG. 9. FIG. 11 is a view showing the relation between the cam slide mechanism 37 of the valve apparatus 35 and the air cleaner 5, the view being a cross-sectional view taken along a line XI-XI of FIG. 9. FIG. 12 is a view showing the relation between the cam slide mechanism 37 of the valve apparatus 35 and the air cleaner 5, the view being a cross-sectional view taken along a line XII-XII of FIG. 9.

As shown in FIGS. 7 to 12, the air cleaner 5 has a body 51, and a filter element 53. The body 51 has a box-shaped configuration inside which a space is formed. For example, the body 51 has: a bottom wall portion 54; a side wall portion 55 that extends from a periphery of the bottom wall portion 54 toward an upper side; and an upper wall portion 511 that covers an upper side of the body 51. It is to be noted that the upper wall portion 511 may be member of a different body from the body 51. In FIG. 7, the upper wall portion 511 is shown with a chain double-dashed line, and an inside of the air cleaner 5 is shown with a continuous line. The filter element 53 is disposed inside the body 51. The space inside the body 51 is partitioned by the filter element 53 into a dirty side chamber 58 on a front side, and a clean side chamber 59 on a rear side.

An inlet 56 for taking in the air from outside is formed at both sides in the horizontal direction (array direction of the combustion chamber 311) of the side wall portion 55 of the dirty side chamber 58. The inlet 56 has a cylindrical configuration extending substantially forward from the both sides of the side wall portion 55. In addition, the right and left inlets 56 are provided at substantially symmetrical positions. Additionally, the dirty side chamber 58 and an outside thereof communicate with each other so that the air can flow by the inlet 56.

A plurality of openings 57 through which the air can flow are formed in the bottom wall portion 54 of the clean side chamber 59. The plurality of openings 57 are formed so as to align in series in the horizontal direction. Additionally, the plurality of intake pipes 323 are connected to the bottom wall portion 54 of the clean side chamber 59, and each opening 57 and each intake pipe 323 communicate with each other. As described above, the clean side chamber 59 and the intake port 321 are connected to (are made to communicate with) each other by the intake pipe 323 so that the air can flow.

A function and behavior of the intake system 9 for the internal combustion engine pertaining to the embodiment of the present invention are as follows. The air is taken in the dirty side chamber 58 of the air cleaner 5 through the inlet 56. The air taken in the dirty side chamber 58 flows toward the rear side, passes through the filter element 53, and flows into the clean side chamber 59. The air is filtered in passing through the filter element 53, and foreign substances (dust etc.) in the air are removed. The air having flowed into the clean side chamber 59 flows into each intake pipe 323 through each opening 57. The fuel injection valve 325 provided in the intake pipe 323 then mixes fuel with the air. The air with which fuel has been mixed (air-fuel mixture) is guided to each intake port 321. The valve apparatus 35 then drives the intake valve 351, and opens and closes between each intake port 321 and each combustion chamber 311. In this case, the cam slide mechanism 37 moves the intake side cam 353 in the axial direction, and thereby a lift amount and lift timing (i.e., an intake amount and intake timing) of the intake valve 351 are changed. As described above, the intake system 9 for the internal combustion engine pertaining to the embodiment of the present invention supplies the combustion air to each combustion chamber 311 of the engine unit 13 as the internal combustion engine.

Next, there will be described a relation between the air cleaner 5 and the cylinder assembly 131. As shown in FIGS. 2 and 9, the motor 371 is provided at one side end in the horizontal direction of the cylinder head cover 33, and the cam position sensor 376 is provided at the opposite one side end. Both the motor 371 and the cam position sensor 376 are disposed so as to protruding upward from the cylinder head cover 33. Additionally, the ball screw 372 and the slide nut 377 are disposed below the motor 371 and the cam position sensor 376 (on a side near an upper surface of the cylinder head 32). Accordingly, a portion recessed substantially toward a lower side (toward the cylinder head 32 side) is formed between the motor 371 and the cam position sensors 376.

In addition, the motor 371 and the cam position sensor 376 are disposed at positions deviated from a center of the cylinder head cover 33 to the intake port 321 side in relation to the front-rear direction. More specifically, in a view in the axial direction of each combustion chamber 311 (seen from a direction of reciprocation of the piston 312), the motor 371 and the cam position sensor 376 are disposed so as to stick out of the upper surface of the cylinder head cover 33 to the side where the intake port 321 is formed. Additionally, in a side view from the horizontal direction (a view in the axial direction of the intake side cam shaft 354), the motor 371 and the cam position sensor 376 are overlapped with each other. As described above, the motor 371 and the cam position sensor 376 are disposed at the positions spaced apart from each other in relation to the horizontal direction, and are disposed at the substantially same positions in the front-rear direction.

The air cleaner 5 is disposed on the upper side of the cylinder head cover 33. Additionally, an outer surface of the bottom wall portion 54 of the air cleaner 5 is opposed to the upper surface(s) of the cylinder head cover 33 (and the ball screw housing 34). A concave portion 60 is formed in an inner peripheral surface of the bottom wall portion 54 of the air cleaner 5. The concave portion 60 is formed in an intermediate portion in the horizontal direction (the axial direction of the intake side cam shaft 354). As shown in FIGS. 9 to 12, the concave portion 60 is a deeper portion (a portion with a larger size in a vertical direction) as compared with the other portions (particularly, both ends in the horizontal direction). An outer surface (a surface on a side opposed to the cylinder head cover 33) of the concave portion 60 bulges toward the cylinder head cover 33 side more than the both ends in the horizontal direction. The bulging outer portion of the concave portion 60 has got into between the motor 371 and the cam position sensor 376 (the portion recessed toward the cylinder head 32 side) (particularly, refer to FIG. 9).

In addition, the air cleaner 5 has a symmetrical configuration in relation to the horizontal direction (axial direction of the intake side cam shaft 354) (particularly, refer to FIG. 8). Specifically, the concave portion 60 is formed at the center in the horizontal direction. The inlet 56 is also provided on both sides of the side wall portion 55, and yet at symmetrical positions. Furthermore, the plurality of openings 57 formed in the clean side chamber 59 are also formed at substantially symmetrical positions. When such configuration is employed, it can be prevented that deviation in an amount of air that flows in the plurality of openings 57 occurs in the horizontal direction. Namely, since the inlet 56 is formed at the symmetrical positions of the side wall portion 55, it is prevented or suppressed that deviation in a flow rate of the air that flows in the dirty side chamber 58 from the inlet 56 occurs in the horizontal direction. Additionally, the air having flowed in the dirty side chamber 58 flows toward the rear side. A cross-sectional area (here, a cross-sectional area of a surface perpendicular to a flow direction of the air) of the concave portion 60 formed in the bottom wall portion 54 of the dirty side chamber 58 is larger as compared with those of the other portions. Therefore, an amount of air that flows through the concave portion 60 is larger as compared with those of the other portions. Additionally, since the concave portion 60 is formed at the center in the horizontal direction, a lot of air flows through the center in the horizontal direction inside the air cleaner 5, and thus deviation is prevented from occurring in the horizontal direction. Accordingly, it can be prevented or suppressed that deviation in the amount of air that flows in the plurality of openings 57 occurs in the horizontal direction.

As shown in FIGS. 10 and 12, the motor 371 and the cam position sensor 376 are provided in a region surrounded by the cylinder head cover 33, the intake pipe 323, and the air cleaner 5. Specifically, the above is as follows.

The intake pipe 323 extends diagonally upward (so as to move away from the cylinder head cover 33) from a surface on the rear side of the cylinder head 32. Additionally, a front portion of the air cleaner 5 is located on the upper side of the cylinder head cover 33, and a rear portion (particularly, a portion where the clean side chamber 59 is formed) of the air cleaner 5 is combined with a tip of the intake pipe 323. As described above, the air cleaner 5 is disposed so as to straddle the upper side of the cylinder head cover 33 and the tip of the intake pipe 323. Therefore, on an upper portion rear side of the cylinder head cover 33, in the side view from the horizontal direction, formed is a region surrounded by the bottom wall portion 54 of the air cleaner 5, a portion from a rear surface upper portion to an upper surface rear portion of the cylinder head cover 33, and the intake pipe 323.

In a planar view of the cylinder head 32 from the axial direction of the combustion chamber 311, a center line of the rotating shaft of the motor 371 has deviated to the intake port 321 side from a center line of the intake side cam shaft 354. Additionally, in a view in the axial direction (reciprocation direction of the piston 312) of each combustion chamber 311, the motor 371 is disposed so as to stick out of the upper surface of the cylinder head cover 33 to the side where the intake port 321 is formed. In addition, the cam position sensor 376 is provided so as to protrude diagonally backward upward from a portion from the rear surface upper portion to the upper surface rear portion of the cylinder head cover 33. As described above, the motor 371 and the cam position sensor 376 are provided in the region surrounded by the cylinder head cover 33, the intake pipe 323, and the air cleaner 5.

With such configuration, (in the planar view from the axial direction of the combustion chamber 311), as compared with a configuration in which the center line of the rotating shaft of the motor 371 and the center line of the intake side cam shaft 354 coincide with each other, a size of the motor 371 protruding upward from the cylinder head cover 33 is smaller. Similarly, the cam position sensor 376 has also deviated to the intake port 321 side from the center line of the intake side cam shaft 354. Therefore, (in the planar view from the axial direction of the combustion chamber 311) as compared with a configuration in which the cam position sensor 376 overlaps with the center line of the intake side cam shaft 354, a size of the cam position sensor 376 protruding upward from the cylinder head cover 33 is smaller. Therefore, as shown in FIGS. 10 and 12, reduction in the cross-sectional areas can be prevented or suppressed in the both ends in the horizontal direction of the air cleaner 5. As a result of this, reduction of a capacity of the air cleaner 5 can be prevented or suppressed.

Furthermore, when such configuration is employed, a space on the upper side of the cylinder head cover 33 can be effectively utilized. Namely, when protrusion sizes of the motor 371 and the cam position sensor 376 from the cylinder head cover 33 become larger, a distance between the cylinder head cover 33 and the air cleaner 5 also becomes larger. In contrast with this, when the sizes of the motor 371 and the cam position sensor 376 that protrude upward from the cylinder head cover 33 become smaller, the air cleaner 5 can be disposed closer to the cylinder head cover 33. Accordingly, the space on the upper side of the cylinder head cover 33 can be effectively utilized.

Actions and effects of a structure of the intake system 9 for the internal combustion engine pertaining to the embodiment of the present invention are summarized as follows.

According to the embodiment of the present invention, compactness in size of the engine unit 13 can be achieved, while preventing or suppressing the reduction of the capacity of the air cleaner 5. Namely, a configuration is employed in which the motor 371 and the cam position sensor 376 of the cam slide mechanism 37 are disposed on the upper side of the cylinder head cover 33, a size in height of the engine unit 13 excluding the air cleaner 5 becomes large. Consequently, if a configuration is employed in which the concave portion 60 is formed in the air cleaner 5 disposed on the upper side of the cylinder head cover 33, and a bulge portion corresponding to the concave portion 60 is disposed between the motor 371 and the cam position sensor 376, increase in the size in the height direction (axial direction of the combustion chamber 311) of the engine unit 13 including the air cleaner 5 can be prevented or suppressed. Additionally, since the concave portion 60 is formed in the air cleaner 5, reduction in the capacity (reduction in a cross-sectional area of a region through which the air flows) can be prevented or suppressed. Accordingly, compactness in size of the engine unit 13 can be achieved, while preventing or suppressing the reduction of the capacity of the air cleaner 5.

According to the embodiment of the present invention, it can be prevented or suppressed that variation occurs in the amount of air that flows in the plurality of intake ports 321. As described above, the concave portion 60 of the bottom wall portion 54 of the air cleaner 5 is formed at the center in the horizontal direction perpendicular to the flow direction of the air. Since a cross-sectional area of the concave portion 60 is larger as compared with the other portions, the amount of air that flows through the concave portion 60 is larger as compared with those of the other portions. Accordingly, a lot of air flows through the center in the horizontal direction inside the air cleaner 5. Additionally, the plurality of openings 57 are also symmetrically arrayed. Therefore, it can be prevented or suppressed that variation occurs in the amount of air that flows in the intake port 321 through each opening 57. Accordingly, according to the embodiment of the present invention, variation in a combustion state among the combustion chambers 311 can be prevented from occurring. As a result of it, can be achieved prevention of variation in occurrence of knocking among the combustion chambers 311, reduction of vibration of the engine unit 13, and improvement in performance of the engine unit 13.

According to the embodiment of the present invention, a space on the upper side of the cylinder head cover 33 and in a vicinity thereof can be effectively utilized. The motor 371 is disposed at one end in the horizontal direction of the cylinder head 32, and the cam position sensor 376 is disposed at one end of an opposite side of the motor 371. The ball screw 372 and the slide nut 377 are disposed between the motor 371 and the cam position sensor 376 in relation to the horizontal direction. Additionally, the ball screw 372 and the slide nut 377 are disposed below the motor 371 and the cam position sensor 376 (on the side near the upper surface of the cylinder head 32). Accordingly, the portion recessed toward the cylinder head 32 side is formed between the motor 371 and the cam position sensors 376. Since the configuration is employed in which the concave portion 60 of the air cleaner 5 is disposed in the portion recessed toward the cylinder head 32 side, the distance of the air cleaner 5 and the cylinder head cover 33 can be reduced. Accordingly, an unnecessary region is prevented from being formed on the upper side of the cylinder head cover 33, and the space on the upper side of the cylinder head cover 33 can be effectively utilized. Additionally, since the space on the upper side of the cylinder head cover 33 can be effectively utilized, reduction in size of the engine unit 13 can be achieved (or grow in size thereof can be prevented or suppressed).

According to the embodiment of the present invention, reduction of the capacity of the air cleaner 5 can be prevented or suppressed. The cylinder assembly 131 is mounted in the motorcycle 1 with an attitude where an axis line (reciprocation direction of the piston 312) of the combustion chamber 311 inclined forward. The intake pipe 323 extending diagonally upward is connected to the cylinder block 31 of the cylinder assembly 131 from each combustion chamber 311. Additionally, the air cleaner 5 is disposed so as to straddle the upper portion of the cylinder head cover 33 and the tip portion of the intake pipe 323. Therefore, in a side view (seen from a direction parallel to the array direction of the combustion chamber 311), the region surrounded by the cylinder head cover 33, the intake pipe 323, and the air cleaner 5 is formed. Additionally, the motor 371 and the cam position sensor 376 of the cam slide mechanism 37 are disposed in the region (to be exact, the motor 371 and the cam position sensor 376 are provided on the cylinder head cover 33, and protrude toward the region). With such configuration, interference of the motor 371 and the cam position sensor 376 with the air cleaner 5 can be reduced, and thus reduction of the capacity of the air cleaner 5 can be prevented or suppressed.

Hereinbefore, the embodiment and example of the present invention have been described in detail with reference to the drawings, but the above-described embodiment and example are shown just as specific examples when the present invention is implemented. The technical scope of the present invention is not limited to the above-described embodiment and example. Various modifications of the present invention can be made without departing from the spirit of the invention, and they are also included in the technical scope of the present invention.

For example, in the above-described embodiment, the configuration has been shown in which the intake system for the internal combustion engine pertaining to the present invention is applied to an on-road type motorcycle, but a type of a motorcycle to which the present invention is applied is not limited. The above-described motorcycle is shown just as one example of a motorcycle to which the present invention can be applied. In addition, the present invention can be applied not only to a motorcycle, but also to, for example, a tricycle for driving in a rough terrain, etc. Furthermore, although the in-line four-cylinder internal combustion engine has been shown in the above-described embodiment, the number of combustion chambers (cylinders) of an internal combustion engine is not limited. In short, if a configuration is employed in which an intake system for an internal combustion engine has a plurality of intake ports for supplying the combustion air to an engine unit from an air cleaner, the present invention can be applied regardless of the number of combustion chambers of the internal combustion engine.

The present invention is a technology effective for an intake system for an internal combustion engine. For example, the present invention can be applied to a motorcycle having an engine unit as an internal combustion engine, and intake systems of the other various vehicles. Additionally, according to the present invention, it can be prevented or suppressed that variation occurs in an amount of air distributed to a plurality of intake ports for supplying the combustion air to an internal combustion engine.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An intake system of components of an internal combustion engine, which supplies combustion air to the internal combustion engine having a combustion chamber and an intake valve that opens and closes the combustion chamber, the internal combustion engine having a cylinder block in which the combustion chamber is formed, a cylinder head provided with a cylinder head cover on an upper side of the cylinder head and with a plurality of intake ports to introduce the combustion air into the combustion chamber, a motor provided on an upper side of the cylinder head cover and exerting drive force to a cam slide mechanism that axially moves a solid cam driving the intake valve, and a cam position sensor provided on the upper side of the cylinder head cover and detecting an axial position of the solid cam, the intake system comprising:

an air cleaner that is provided on an upper side of the cylinder head cover, the motor and the cam position sensor, and takes in and cleans the combustion air from outside, wherein:

the air cleaner comprises a body which has a box-shaped configuration inside which a space is formed and has a bottom wall portion, a side wall portion that extends from a periphery of the bottom wall portion toward an upper side, and an upper wall portion that covers an upper side of the body;

a concave portion is provided with the bottom wall portion at a center portion in a horizontal direction of the bottom wall portion, the concave portion having a larger depth in a vertical direction compared to an edge portion of the bottom wall portion, surrounding the center portion, and bulging toward a cylinder head cover side;

an inlet for taking in air from outside is provided with the side wall portion at both sides in the horizontal direction of the side wall portion;

the inlet has a cylindrical configuration extending substantially diagonally forward from the both sides of the side wall portion;

the air taken in from the inlet flows into a space enlarged by the concave portion;

openings are provided with the bottom wall portion of the air cleaner so as to be arrayed in series, each of the openings communicating with each of the intake ports, respectively; and the concave portion is provided between the motor and the cam position sensor.

2. The intake system of components of the internal combustion engine according to claim 1, wherein the concave portion is disposed above the cam slide mechanism.

3. The intake system of components of the internal combustion engine according to claim 1, further comprising:

an intake pipe provided to connect each of the openings of the bottom wall portion with each of the intake ports, respectively, to make the air flow between the air cleaner and the intake ports, wherein the motor is disposed in a region surrounded by the air cleaner, the cylinder head cover, and the intake pipe.

4. The intake system of components of the internal combustion engine according to claim 1, further comprising:

an intake pipe provided to connect each of the openings of the bottom wall portion with each of the intake ports, respectively, to make the air flow between the air cleaner and the intake ports, wherein the cam position sensor is disposed in a region surrounded by the air cleaner, the cylinder head cover, and the intake pipe.

* * * * *